United States Patent [19]

Durnell

[11] 4,116,304

[45] Sep. 26, 1978

[54] AERIAL PERSONNEL LIFT INCLUDING MEANS FOR AUTOMATICALLY CONTROLLING THE POSITION OF THE PERSONNEL BUCKET

[75] Inventor: Morris S. Durnell, Emmetsburg, Iowa

[73] Assignee: Durnell Engineering, Inc., Emmetsburg, Iowa

[21] Appl. No.: 790,307

[22] Filed: Apr. 25, 1977

[51] Int. Cl.[2] ..... B66F 11/04

[52] U.S. Cl. ..... 182/2; 182/19

[58] Field of Search ..... 182/19, 2

[56] References Cited

FOREIGN PATENT DOCUMENTS 550,896 11/1956 Italy ..... 182/2

*Primary Examiner*—Reinaldo P. Machado

*Attorney, Agent, or Firm*—Zarley, McKee, Thomte, Voorhees & Sease

[57] ABSTRACT

An aerial lift comprising a wheeled frame having a telescoping boom pivotally and rotatably mounted thereon. A personnel bucket is pivotally secured to one end of the boom for supporting a person therein. An electrical screw-motor apparatus is pivotally secured to and extended between the bucket and the boom. A plurality of mercury switches are mounted on the bucket and are electrically connected to the screw-motor and the source of electrical power so that the screw-motor is automatically actuated responsive to vertical movement of the boom so as to maintain the personnel bucket in a vertical position at all times. The screw-motor also acts as a snubber to prevent undesirable movement of the bucket at work levels.

4 Claims, 6 Drawing Figures

AERIAL PERSONNEL LIFT INCLUDING MEANS FOR AUTOMATICALLY CONTROLLING THE POSITION OF THE PERSONNEL BUCKET

BACKGROUND OF THE INVENTION

Aerial lifts are commonly mounted on wheeled vehicles such as trucks, trailers, etc. The conventional lifts normally comprise an extendable boom means which has one end pivotally and rotatably secured to the truck so that the personnel bucket which is pivoted to the other end of the boom means may be positioned at the desired work level. The personnel buckets are normally pivotally secured about a horizontal axis to the end of the boom means. The position of the bucket is ordinarily controlled by a gravity level system with a hydraulic snubber or a disc brake apparatus. Thus, when the hydraulic snubber and disc brake are disengaged, the bucket is free to pivot relative to the boom. The hydraulic snubbers and disc brakes are normally disengaged as the boom is being manueuvered and such free pivotal movement between the boom and the bucket can result in injury to the person in the bucket. Additionally, the weight of the bucket and the person therein is not always balanced so that the bucket is tilted when the bucket reaches the desired work level and such an attitude creates a dangerous situation.

Therefore, it is a principal object of the invention to provide an aerial personnel lift which includes means for automatically positioning and maintaining the personnel bucket in a vertical position.

A further object of the invention is to provide an aerial lift which includes an electrical screw-motor pivotally secured to and extending between the boom and the bucket to maintain the bucket in the desired position regardless of the vertical position of the boom.

A still further object of the invention is to provide an aerial lift which is economical to manufacture, durable in use, safe to operate and refined in appearance.

These and other objects will be apparent to those skilled in the art.

BRIEF DESCRIPTION OF THE PREFERRED EMBODIMENT

Figure 1:
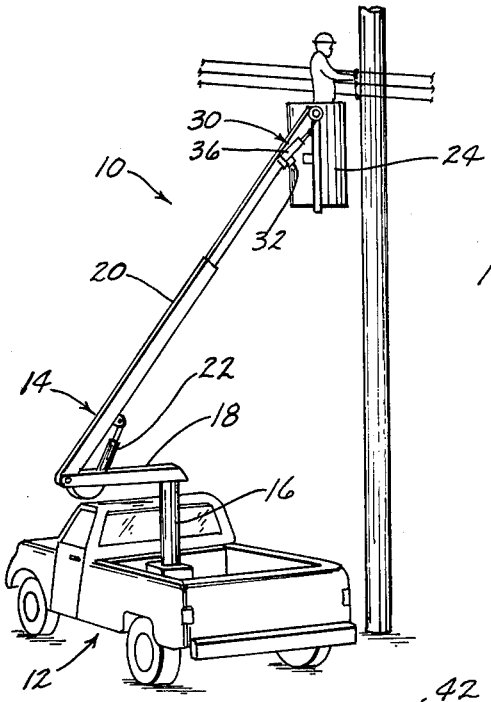
FIG. 1 is a perspective view of an aerial lift showing the device of this invention mounted thereon.
Figure 2:
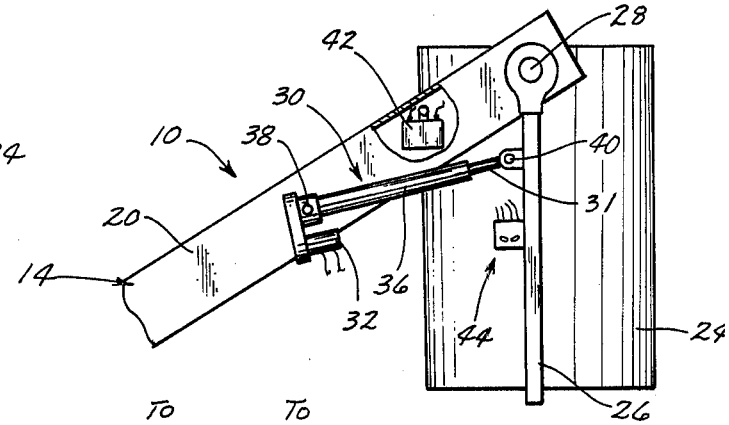
FIG. 2 is a side view of the device of this invention with a portion of the boom cut away to more freely illustrate the invention.
Figure 3:
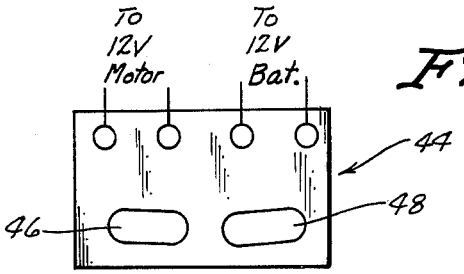
FIG. 3 is a side view of switch mountings.

The aerial lift of this invention is referred to generally by the reference numeral 10 and comprises a wheeled frame means such as a truck 12 having a telescoping boom means 14 mounted thereon. Boom means 14 generally comprises a pedestal 16 mounted in the bed of the truck and having a boom arm 18 rotatably mounted on the upper end thereof. A telescoping boom apparatus 20 is pivotally connected to the outer end of boom arm 18. Hydraulic cylinder 22 is connected to the boom apparatus 20 to raise and lower the boom apparatus in conventional fashion.

A conventional personnel bucket 24 including a bucket frame 26 is pivotally connected to the end of the boom apparatus 20 at 28. The pivotal connection between the bucket frame 26 and the boom apparatus 20 is horizontally disposed transverse to the longitudinal axis of the boom apparatus 20. The numeral 30 refers to a length adjustable means such as the conventional screw-motor illustrated in the drawings. The screw-motor 30 includes an electrical motor 32 operatively connected to the screw element 34 which may be extended from or retracted relative to the housing 36 in conventional fashion. It can be seen in the drawings that one end of the screw-motor 30 is pivotally connected to the boom apparatus 20 at 38 and that the outer end of the screw element 34 is pivotally connected to the bucket frame 26 at 40.

Preferably, the motor 32 is of the 12 volt direct current type and is operatively connected to a 12 volt battery 42 positioned within the boom apparatus 20. The numeral 44 refers to a switch assembly which is mounted on the bucket frame 26 as illustrated in the drawings. Switch assembly 44 includes a pair of mercury switches 46 and 48 which are disposed relative to each other as illustrated in the drawings. The mercury switches 46 and 48 are each of the double pole, double throw type and are connected to the motor 32 and the power source 42 as illustrated. The numerals 47 and 49 refer to the mercury in switches 46 and 48 respectively.

Figure 4:
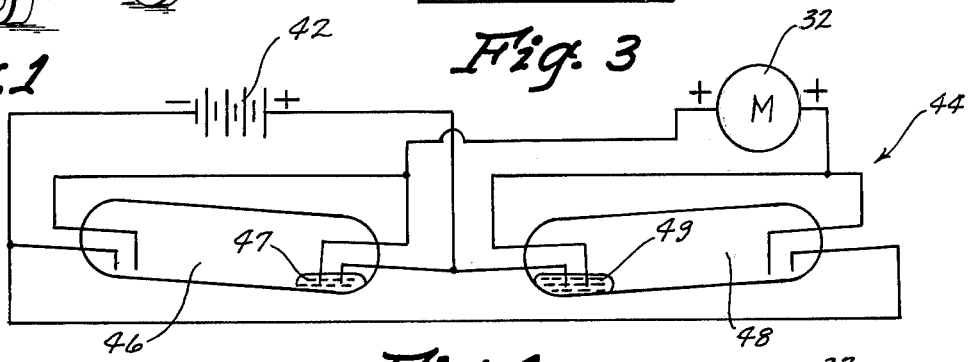
FIG. 4 is a schematic illustration of the switches in a first position.
Figure 5:
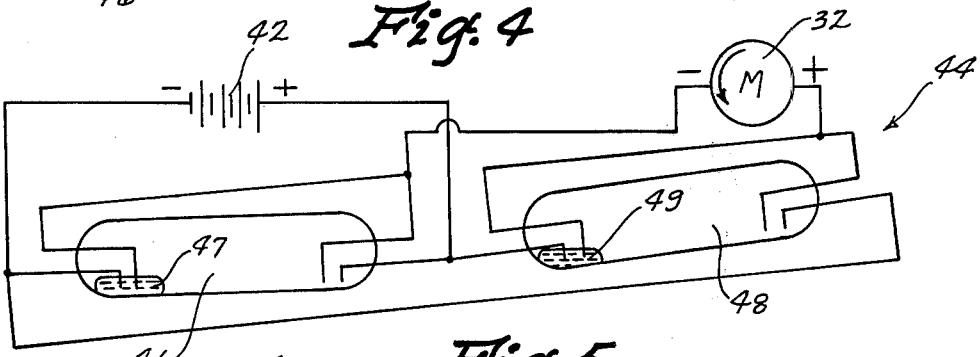
FIG. 5 is a view similar to FIG. 4 except that the switches are in a second position.
Figure 6:
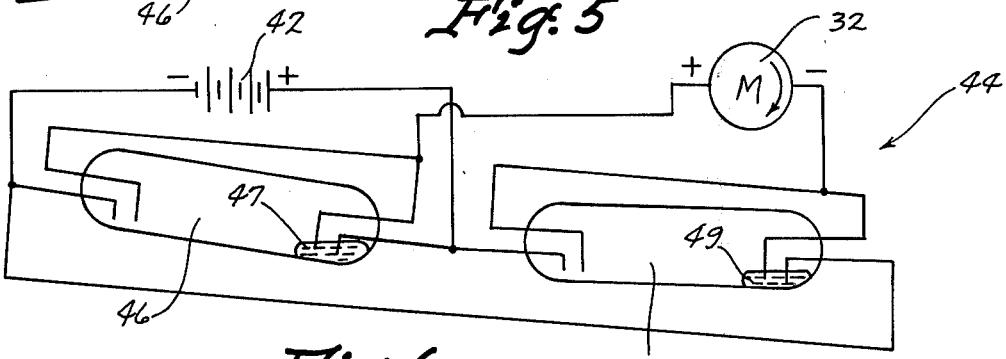
FIG. 6 is a view similar to FIGS. 4 and 5 except that the switches are in a third position.

FIG. 4 illustrates the position of the switches 46 and 48 when the bucket is in the vertical position. When the switches are disposed as viewed in FIG. 4, the motor 32 will not run as it has only one polarity. In the event that the bucket should be tilted to the left, the switches 46 and 48 will be positioned as illustrated in FIG. 5 so that the motor will be operated to retract screw element 34 to pull the bucket to a vertical position. FIG. 6 illustrates the position of the switches 46 and 48 when the bucket is tilted to the right. As illustrated in FIG. 6, the switches cause the polarity to be reversed which reverses the motor to extend the screw element 34 to push the bucket to a vertical position.

Thus, as the boom 20 is pivotally moved with respect to the boom arm 18, the screw-motor 30 is automatically actuated by the switch assembly 44 to maintain the bucket in a vertical position. The bucket is maintained in a vertical position as the boom apparatus 20 is maneuvered so that the bucket cannot freely swing which could otherwise create a dangerous situation. When the boom 20 has been raised to the desired work level, the bucket is automatically positioned in the vertical position regardless of the weight distribution therein. The worm drive of the screw-motor 30 acts as a snubber to maintain the bucket in the vertical position as the person is working therein to prevent free swinging of the bucket.

Thus it can be seen that a novel means has been provided for automatically maintaining the personnel bucket of an aerial lift in a vertical position regardless of the attitude of the telescoping boom. Thus it can be seen that at least all of the stated objectives are accomplished.

I claim:

1. An aerial personnel lift comprising, a wheeled frame means, a boom means having one end operatively pivotally and rotatably secured to said frame means, an aerial personnel bucket means pivotally secured to the other end of said boom means about a horizontal axis transverse to the longitudinal axis of said boom means, an electrically activated length adjustable means pivotally secured to and extending between said boom means and said bucket means, a source of electric power for said length adjustable means, an electrical switch assembly rigidly secured to said bucket means and including a pair of elongated mercury switches secured to said switch assembly in stationary relation to said bucket means and inclined relative to a horizontal plane when said bucket means is in a vertical position, said mercury switches electrically connected to said length adjustable means and said source of electric power for automatically activating said length adjustable means responsive to vertical movement of said boom means and pivotal movement of said bucket means so that said bucket means is maintained in a substantially vertical position.

2. The lift of claim 1 wherein said mercury switches are each of the double pole double throw type, said source of electric power including positive and negative terminals and said length adjustable means having opposite electrical terminals, one end of each of said mercury switches being electrically connected to said positive terminal and the other end of each of said mercury switches being electrically connected to said negative terminal, and both ends of one of said mercury switches being electrically connected to one terminal of said length adjustable means and both ends of the other of said mercury switches being electrically connected to the opposite terminal of said length adjustable means.

3. The lift of claim 2 wherein said pair of mercury switches are oppositely inclined relative to one another so that there is at all times an electrical connection between at least one terminal of said length adjustable means and one terminal of said source of electric power.

4. The lift of claim 2 wherein said length adjustable means comprises an electrically operated screw-motor means.

* * * * *